United States Patent [19]

Anzaldua et al.

[11] 4,296,924

[45] Oct. 27, 1981

[54] TORSION EXERCISE APPARATUS

[75] Inventors: Alfred B. Anzaldua; David A. Anzaldua; Benjamin R. Sturgeon, all of Peoria, Ill.

[73] Assignee: Health Innovations, Inc., Peoria, Ill.

[21] Appl. No.: 175,147

[22] Filed: Aug. 4, 1980

[51] Int. Cl.[3] ..... A63B 21/06

[52] U.S. Cl. ..... 272/117; 272/143; 272/134

[58] Field of Search ..... 272/117, 118, 134, 132, 272/136, 140, 141, 143, 142; 434/45

[56] References Cited

U.S. PATENT DOCUMENTS 1,585,748 5/1926 Wendelken ..... 272/146 X
3,640,527 2/1972 Proctor ..... 272/118
3,912,261 10/1975 Lambert ..... 272/118
3,926,430 12/1975 Good ..... 272/130

*Primary Examiner*—Richard C. Pinkham
*Assistant Examiner*—William R. Browne
*Attorney, Agent, or Firm*—David D. Kaufman

[57] ABSTRACT

The apparatus includes adjustable weights which may be raised by rotational movement of a wheel about a vertical axis. Handles are mounted on a common, rigid horizontal cross bar to cradle the user's shoulders, arms and hands therein. By remaining upright and positioning his body within the handles, the user can exercise against the weight resistance by twisting motions of his torso. The handles are gripped and rotated simultaneously by a user's hands. This rotation, in either a clockwise or counter-clockwise direction, will cause the wheel, which is rotatable about a vertical axis, to raise and lower weights.

12 Claims, 6 Drawing Figures

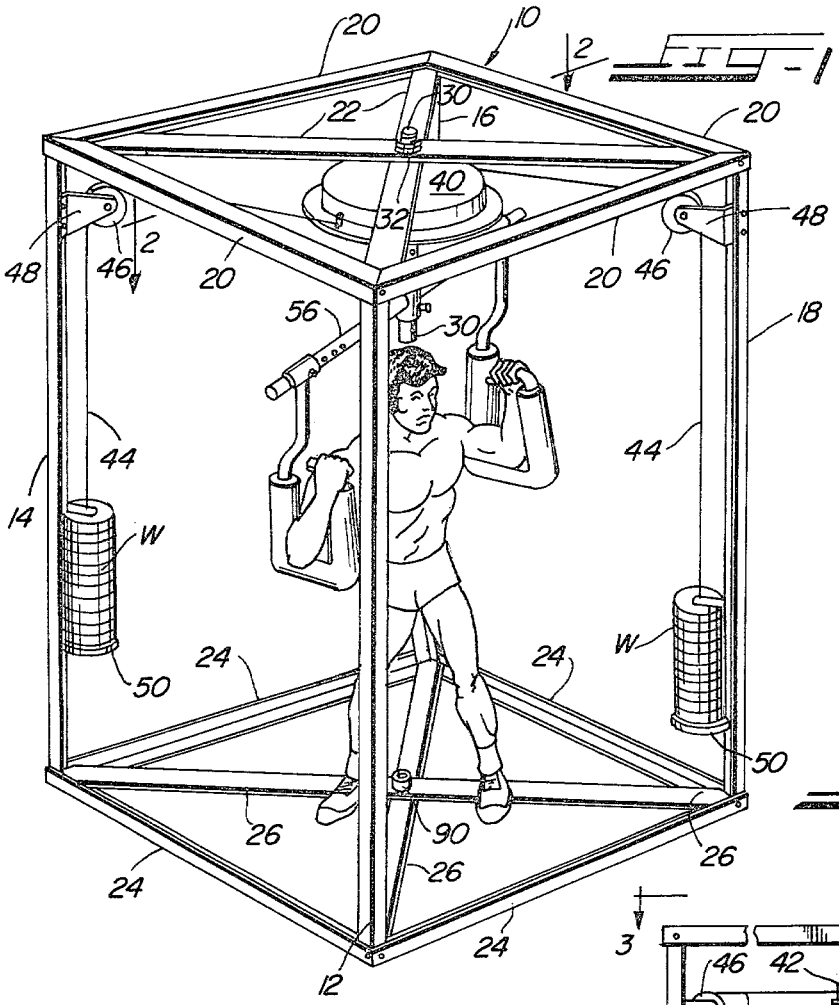
FIG-1
FIG-3
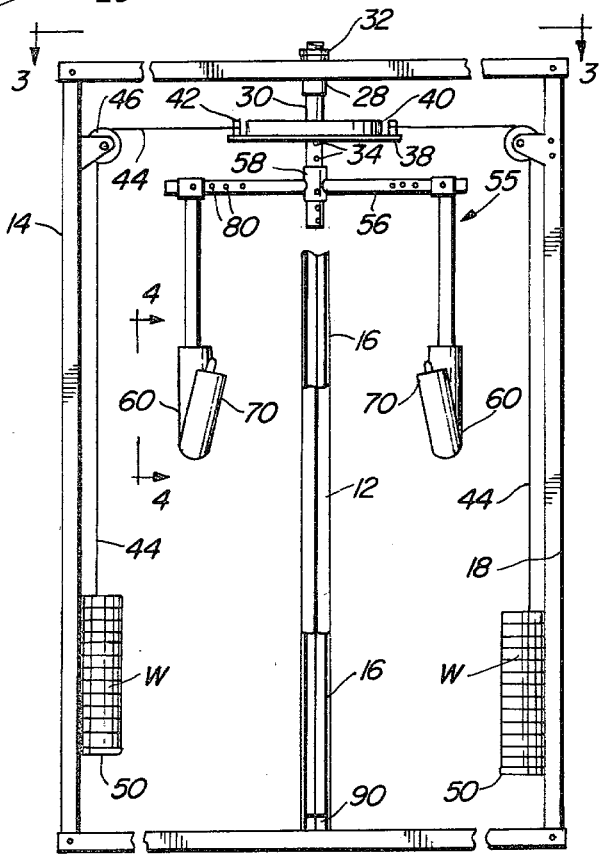
FIG-2
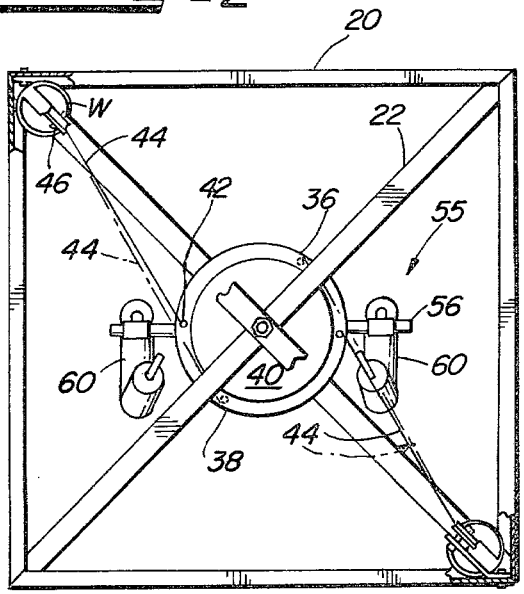

TORSION EXERCISE APPARATUS

This invention relates generally to physical exercise machines and, more particularly, to apparatus designed for exercise and development of the torso muscles involved in rotational or twisting motions.

Beneficial results obtainable by physical exercise against increasing or adjustable resistance, such as provided by weights, has long been recognized. Heretofore, there have been provided a wide variety of machines intended to capitalize on this principle. Exemplary of such prior art machines are those shown in U.S. Pat. Nos. 3,012,776; 3,089,700; 3,708,166; 3,912,261; 4,093,214; and 4,125,258.

As seen in the cited patents, those prior devices are designed primarily for exercise of the limbs. Further study of prior exercise devices indicates that they have largely emphasized development of the muscles involved with linear movements of the limbs and trunk, that is, the development of strength in the vertical plane.

Analysis of the types of movements required in many sports reveals that twisting motions of the torso are equally, if not more, important than linear motions for successful performance. Typically, such twisting or torsional movements may be described as explosive in nature, some examples of which are: batting a baseball, the cross punch in boxing, forehand or backhand strokes in tennis, and the long drive in golf. We are unaware of any existing exercise machine designed to fill the need for this type of muscular development.

It is therefore an object of the present invention to provide an exercise machine designed for development of the muscles involved in rotational or torsional movements of the torso. A related object is to provide such a machine for exercising the anterior abdominal muscles, external and internal oblique, and the posterior paraspinal muscles, members of the erector spinae group. These muscles may be appropriately labeled as the prime movers involved in torso rotation.

A further object is to provide an exercise machine designed for the achievement of maximum torso flexibility and full range of rotational movements.

In accordance with this invention, the apparatus comprises generally a pair of cradle-like handles. The user may stand or sit between the handles and cradle his shoulders, arms and hands therein. A take-up wheel rotatable about a vertical axis is positioned above the user's head and has adjustable weights attached by cables thereto at diametrically opposed points. The handles are mounted on a horizontal cross bar for simultaneous movement, and said cross bar is attached to the vertical axis of rotation of the wheel so that the user can exert rotational force in either direction against the handles and the resistance of the weights. In one embodiment of the apparatus, the user stands directly under the vertical axis of rotation, while in a second, he may stand with his back pressed up against that axis of rotation.

Another object of the invention is to provide an exercise apparatus of the character described which may be readily converted from one to the other embodiments as desired.

A further object is to provide an exercise apparatus of the character described which is readily adjustable for use by persons of all sizes.

Still another object is to provide an exercise apparatus of the character described which may be employed in a variety of exercises for developing the toro muscles. For example, it is an object that the apparatus may be used in high resistance-low repetition exercises to develop strength or low resistance-high repetition exercises for reduction of trunk and abdomen size.

Yet another object is to provide an exercise apparatus of the character described which is durable and of simple construction and yet is most efficient and beneficial for the purposes intended.

Other objects, features and advantages of the invention will be apparent from the following detailed disclosure, taken in conjunction with the accompanying drawings, wherein like reference numerals refer to like parts, in which:

FIG. 1 is a perspective view of the invention showing a user after having twisted his torso through approximately 45° in the counterclockwise direction;

FIG. 2 is a top plan view, with portions broken away, taken on the plane of line 2—2 in FIG. 1;

FIG. 3 is a front, corner elevational view showing the relationship of parts in the neutral or non-use condition;

Figure 4:
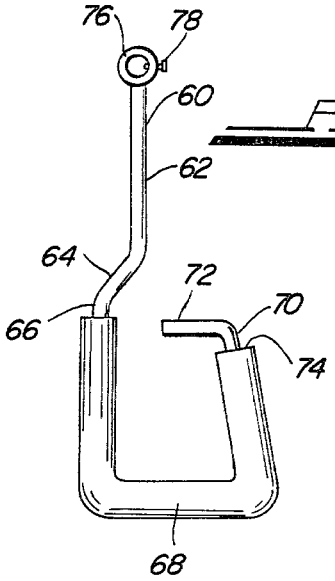
FIG. 4 is a side elevational view taken on the plane of line 4—4 in FIG. 3 and illustrating the handle structure.

Referring now in greater detail to the various figures of the drawings, it will be seen that the reference character 10 indicates generally an exercise apparatus embodying the principles of the invention. Apparatus 10 comprises a sturdy, vertically oriented, framework having vertical beams 12, 14, 16 and 18, horizontal top beams 20 and cross braces 22, and horizontal bottom beams 24 and cross braces 26.

A bushing 28 depends from the center of the top cross braces 22 and said bushing accommodates therethrough a rotatable shaft 30. The shaft 30 extends above the top cross braces 22 and suitable means such lock nuts 32 and bearing means (not shown) are provided for retaining the shaft and permitting free rotation thereof in the bushing 28. The shaft 30 is of relatively short length to permit the user to stand therebeneath and, it will be noted that the same is formed with a series of adjustment openings 34 for reasons which will become apparent.

Rigidly mounted on the post 30 is a take-up wheel 36, comprising a horizontal flange 38 and a reduced diameter drum 40. A pair of bolts 42 are mounted on the wheel flange 38 at diametrically opposed points and said bolts secure cables such as 44, 44, to the wheel. The cables 44 pass over opposed pulleys 46, 46, mounted by brackets 48, 48, on vertical beams 14 and 18, and said cables carry plates 50 adapted to support adjustable weights W thereon in well known manner.

A handle bar subassembly 55 is releasably mounted on the shaft 30 for operation of the apparatus. Subassembly 55 comprises a horizontal cross bar 56 having a sleeve 58 at the center thereof adapted to slidably fit on the shaft 30. The sleeve 58 is provided with an opening which may be aligned with a shaft opening 34 whereby a pin or bolt can be passed therethrough to retain the cross bar 56 at any desired position.

Releasably mounted on each end of the cross bar 56 is a handle 60 which comprises a substantially vertical segment 62, a short, rearwardly angular segment 64, a substantially vertical rear segment 66, a horizontal bottom segment 68, an upwardly angular segment 70 and a substantially horizontal top segment 72. Handle 60 thus has the form of an angular hook or eyelet and the same may be covered with a suitable padding 74 as indicated. It will be noted that the upwardly angular segment 70 additionally tapers inwardly and lies out of the vertical plane of the remainder of the handle 60 (see FIGS. 2 and 3). The handles thus are adapted to comfortably cradle portions of the user's shoulders, arms and hands therein (see FIG. 1) with the result that exertion of rotational force by either shoulder and arm automatically drives the opposite shoulder and arm to rotate in the same direction.

At the upper end of the vertical segment 62, there is affixed a mounting sleeve 76 which is adapted to slidably fit on the horizontal cross bar 56. The mounting sleeve 76 is provided with a positioning pin or bolt 78 which is adapted to cooperate with holes 80 formed at each end of the cross bar 56. It will thus be appreciated that the spacing between the handles 60 may be readily adjusted as desired to accommodate persons of differing sizes.

When the apparatus is at rest, the parts thereof assume the neutral position illustrated in FIG. 3 of the drawings. To operate the apparatus, the user positions himself between the handles 60 and cradles his shoulders, arms, forearms and hands within the hook-like members as seen in FIG. 1. By applying rotational pressure against a handle 60 with either shoulder or arm, the user may now rotate his torso in either direction; such motion in either direction automatically compelling the other shoulder and arm to likewise rotate in the same direction. The rotational force causes the wheel 36 to rotate so that both cables 44 are wrapped around the drum 40 to raise the opposed weights W. It will be appreciated that the apparatus could also operate with only a single cable 44 and set of weights W. However, the double, opposed arrangement is desirable for purposes of structural balance and also because it increases the rotational force tending to return the wheel to the neutral position upon each reversal of rotational direction by the user. The user thus can beneficially work against the resistance of the weights in all stages of his exercise movements.

Figure 6:
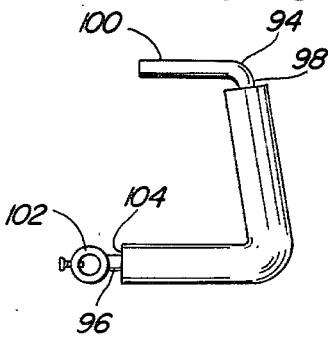
FIG. 6 is a side elevational view taken on the plane of line 6—6 in FIG. 5 and illustrating the handle structure of the modified form.
Figure 5:
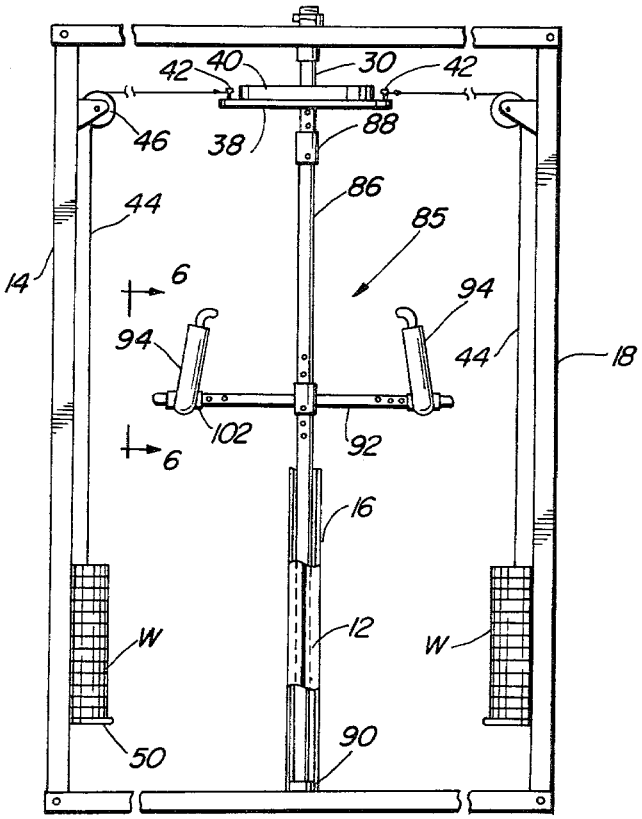
FIG. 5 is an elevational view similar to FIG. 3, but showing a modified form of the invention in the neutral position.

Referring now to FIGS. 5 and 6, the modified form of the apparatus and the manner of converting thereto will be described. Here, the handle bar assembly 55 is removed and replaced by a post-handle bar subassembly 85. Subassembly 85 comprises a vertical post 86 having a top connecting collar 88 and being of a length to seat in a circular bearing member 90 projecting upwardly from the center of the bottom cross braces 26 and connect to the shaft 30. A cross bar 92 is adjustably mounted on the post 86 in manner similar to that previously described for the cross bar 56 and shaft 30.

A handle 94 is adjustably mounted at each end of the cross bar 92. In this instance, the handles comprise a horizontal segment 96, an upwardly angular segment 98 and a substantially horizontal top segment 100. The horizontal segment 96 carries a mounting sleeve 102 and suitable padding 104 may also be provided. Again, it will be seen that the handle 94 comprises a hook-like or eyelet member for cradling the user's shoulders, arms and hands therein. Here, however, the handle is open at its rear and the user instead can stand upright with his back or spine bearing against the post 86 to change somewhat the muscular motions and stresses involved in the exercises.

Conversion from one form of the invention to the other may be readily achieved by substitution of one subassembly for the other in manner believed to be apparent without further description. It should also be appreciated that either form of the invention may, if desired, be operated from a seated position, as well as standing, by employing an appropriately shaped and mounted seat or chair.

It will be understood that modifications and variations may be effected without departing from the scope of the novel concepts of the present invention, but it is understood that this application is to be limited only by the scope of the appended claims.

The invention is hereby claimed as follows:

1. Exercise apparatus comprising:

a vertically oriented framework;

wheel means carried by said framework and rotatable about a vertical axis;

adjustable resistance means connected to said wheel means and adapted to resist rotation thereof; and a pair of horizontally spaced handle means connected to said wheel means for simultaneous rotation in the same direction, each said handle means including a handle, said handles being spaced apart sufficiently to accommodate a user therebetween and permit the user to grip both handles simultaneously with his hands and, by rotating the handles and his torso about the wheel's vertical axis, rotate said wheel means in either a clockwise or counterclockwise direction and work against said resistance means.

2. Apparatus according to claim 1 and comprising further a horizontal cross bar connected to said wheel means, said handles being mounted on said cross bar.

3. Apparatus according to claim 2 in which each of said handles comprises a hook-like member adapted to cradle therein portions of a user's shoulders, arms and hands.

4. Apparatus according to claim 3 in which said vertical axis comprises a rotatable shaft depending from the top of said framework, and means releasable mounting said cross bar on said shaft, whereby a user can position himself beneath said cross bar and shaft to operate the apparatus.

5. Apparatus according to claim 4 and comprising further cooperating adjustment means on said shaft and cross bar for adjusting the vertical position of said cross bar.

6. Apparatus according to claim 5 in which said handles are dependingly mounted from said cross bar, and comprising further cooperating adjustment means on said cross bar and handles for adjusting the horizontal spacing between said handles.

7. Apparatus according to claim 4 and comprising further a vertical post and means for releasably connecting the post to said shaft and the base of the framework so that the shaft and post comprise said vertical aixs, said cross bar being mounted medially on said post so that a user can bear against the post during operation of the apparatus.

8. Apparatus according to claim 7 and comprising further cooperating adjustment means on said post and cross bar for adjusting the vertical position of said cross bar.

9. Apparatus according to claim 8 and comprising further cooperating adjustment means on said cross bar and handles for adjusting the horizontal spacing between said handles.

10. Apparatus according to claim 1 in which said resistance means comprises variable weights carried by cable and pulley means mounted on said framework for vertical movement.

11. Apparatus according to claim 10 in which said wheel means comprises a flange and a reduced diameter drum, so that rotation of the wheel means causes a cable to be taken up by said drum .

12. Apparatus according to claim 11 in which there are two sets of said variable weights, cable and pulley means, said cable and pulley means including cables connected to said flange at diametrically opposed points thereof.

* * * * *